United States Patent [19]

Yubakami et al.

[11] Patent Number: 4,752,598

[45] Date of Patent: Jun. 21, 1988

[54] THERMAL DYE TRANSFER ASSEMBLY FOR HEAT TRANSFER RECORDING

[75] Inventors: Keiichi Yubakami; Hiromu Matsuda, both of Osaka; Akihiro Imai; Nobuyoshi Taguchi, both of Ikoma, all of Japan

[73] Assignee: Matsushita Electric Industrial Co., Ltd., Japan

[21] Appl. No.: 885,696

[22] Filed: Jul. 15, 1986

[30] Foreign Application Priority Data

| | | | |
|---|---|---|---|
| Jul. 15, 1985 | [JP] | Japan | 60-155433 |
| Jul. 17, 1985 | [JP] | Japan | 60-157201 |
| Jul. 24, 1985 | [JP] | Japan | 60-163417 |

[51] Int. Cl.[4] ..... B41M 5/26

[52] U.S. Cl. ..... 503/227; 8/471; 428/195; 428/211; 428/423.1; 428/423.7; 428/425.1; 428/480; 428/481; 428/482; 428/483; 428/514; 428/522; 428/913; 428/914

[58] Field of Search ..... 8/470, 471; 428/195, 428/913, 914, 207, 211, 423.1, 423.7, 425.1, 480–483, 500, 514, 522; 430/945; 503/227

[56] References Cited

U.S. PATENT DOCUMENTS

| | | | |
|---|---|---|---|
| 4,038,257 | 7/1977 | Suzuki et al. | 260/75 NK |
| 4,555,427 | 11/1985 | Kawasaki et al. | 428/195 |

FOREIGN PATENT DOCUMENTS

| | | | |
|---|---|---|---|
| 111011 | 6/1984 | European Pat. Off. | 503/227 |
| 51-037193 | 3/1976 | Japan | 503/227 |
| 58-162374 | 9/1983 | Japan | 503/227 |
| 58-212994 | 12/1983 | Japan | 503/227 |
| 58-215398 | 12/1983 | Japan | 503/227 |

OTHER PUBLICATIONS

Ogasawara, T., "Oligoacrylates", *Functional Materials,* pp. 41–43, Jul. 1982.

*Primary Examiner*—Bruce H. Hess

*Attorney, Agent, or Firm*—Lowe, Price, LeBlanc, Becker & Shur

[57] ABSTRACT

Dye-receiving sheets for heat transfer recording comprising on a substrate, a dye-receiving layer consisting essentially of a cured product of an acrylate having two acrylic or methacrylic unsaturated bonds. The sheet is used in combination with a dye transfer sheet comprising a sublimable dye, and has a high affinity for the dye and a high heat resistance without bleeding of the dye.

13 Claims, 1 Drawing Sheet

THERMAL DYE TRANSFER ASSEMBLY FOR HEAT TRANSFER RECORDING

BACKGROUND OF THE INVENTION

1. Field of the Invention

This invention relates to heat-transfer recording and more particularly, to dye-receiving sheets for use in thermal transfer recording systems in which a dye transfer sheet is heated in an imagewise pattern by means of a heat source such as a thermal head or laser beam and a dye contained in the dye transfer sheet is sublimated or vaporized to record an intended image on a dye-receiving layer of the dye-receiving sheet.

2. Description of the Prior Art

Known dye-receiving sheets can be broadly classified into the following three groups with respect to the dyeing layer thereof.

(1) A dye-receiving layer made of a crosslinked product of a composition which comprises from 20 to 98 parts by weight of a thermoplastic resin having good dyeing affinity and, correspondingly, from 80 to 2 parts by weight of a compound having, in one molecule thereof, at least two radically polymerizable unsaturated bonds (Japanese Laid-open Patent Application No. 58-212994).

(2) A dye-receiving layer consisting of a thermoplastic polyester resin and a crosslinked polymer resin (Japanese Laid-open Patent Application No. 58-215398).

(3) Formation of a UV-cured resin film on polyvinyl chloride articles (Japanese Laid-open Patent Application No. 58-162374).

These dye-receiving sheets have the following drawbacks.

(a) Because the compound having radically polymerizable unsaturated bonds in (1) does not have good dyeing properties, the recording density lowers owing to the incorporation of the compound in the dye-receiving layer.

(b) The dye-receiving layer proposed in (2) does not have a satisfactory heat resistance. If the thermal transfer recording or printing is effected such that a dye transfer sheet and a dye image acceptor sheet are run at different speeds for recording, the resin carrying the dye on the dye transfer sheet thermally sticks with the dye acceptor sheet. For instance, when the dye transfer sheet is fed at a rate of 1/n, in which $n>1$, relative to the the running speed of the image acceptor sheet, the thermal sticking takes place, so that the dye transfer sheet and the dye acceptor sheet cannot be run at predetermined speeds. The above running mode may be hereinafter referred to as "n-fold variable mode".

(c) The technique proposed in (3) is a so-called sublimation printing technique in which printing is effected using sublimable dyes. This technique does not ensure satisfactory dyeing affinity when high temperature recording is effected within a short time in the order of milliseconds.

(d) In (3), a UV-cured film is formed, but it is inevitable that a UV-curing resin or UV-curing initiator remain unreacted and thus, react with dyes. Accordingly, the accepted dye inconveniently undergoes discoloration and decoloration.

SUMMARY OF THE INVENTION

It is an object of the present invention to provide a dye-receiving sheet for thermal transfer recording which comprises a dye-receiving layer comprising a cured product of a specific type of acrylate whereby the drawbacks of the prior art sheets are overcome.

It is another object of the invention to provide a dye-receiving sheet which is suitably adapted for different recording modes including not only a non-variable mode in which the dye-receiving sheet and a dye transfer sheet are run at the same speed, but also a variable mode in which the respective sheets are run at different speeds.

The present invention is characterized in that a dye-receiving sheet used in combination with a sublimable dye-carrying transfer sheet comprises a layer of a cured product comprising an acrylate having two acrylic or methacrylic unsaturated bonds in the molecule thereof.

DETAILED DESCRIPTION AND EMBODIMENTS OF THE INVENTION

Figure 1:
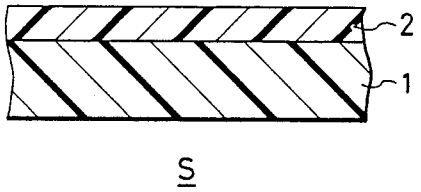
FIG. 1 is a schematic sectional view of a dye-receiving sheet according one embodiment of the invention.

Reference is now made to the accompanying drawings and particularly, to FIG. 1. In the figure, there is shown a dye-receiving sheet S which includes a substrate 1 on which a dye-receiving layer 2 comprising a cured product of an acrylate is arranged. The substrate 1 may be sheets or films of woodfree paper, coated paper, art paper, synthetic paper, polymers such as polypropylene, polyethylene terephthalate, triacetyl cellulose and the like. The dye-receiving layer 2 should comprise and preferably consists of a cured product of an acrylate having two acrylic or methacrylic unsaturated bonds therein. The cured product of the acrylate having two acrylic or methacrylic unsaturated bonds has good affinity for sublimable dyes. Examples of the acrylates include epoxy acrylates, polyester acrylates, urethane acrylates, oligoacrylates, polyester urethane acrylates, and the like. Of these, oligoacrylates and polyester urethane acrylates are preferred. Oligoacrylates are advantageously used from the industrial point of view because of the high reactivity. Similarly, the polyester urethane acrylates are preferred because of the high affinity for sublimable dyes. Of various polyester urethane acrylates, acrylate compounds of the following formula (A) are more preferred

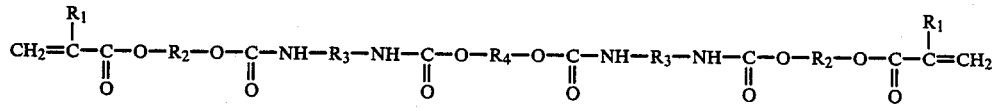

(A)

in which each $R_1$ represents H or $CH_3$, each $R_2$ represents a dihydric alcohol residue, each $R_3$ represents an organic diisocyanate residue, and $R_4$ represents a polyester residue having hydroxyl groups at opposite ends of the molecule. The reason why the compounds of the formula (A) are more preferred is that the —O—R-$_4$—O— bond is capable of imparting high dyeing properties and high flexibility to the resulting cured product.

The dihydric alcohol residues represented by $R_2$ in the formula (A) are those residues derived from dihydric alcohols. Examples of the dihydric alcohols include ethylene glycol, 1,2-propanediol, 2,2-dimethyl-1,3-propanediol, 1,3-butanediol, 1,4-butanediol, 1,5-pentenediol, 1,6-hexandiol, 1,9-nonanediol, 1,4-cyclohexanediol and the like. Preferably, dihydric alcohols having 6 or less carbon atoms are used because a higher heat resistance is ensured.

The organic diisocyanate residues represented by $R_3$ in the formula (A) are residues derived from organic diisocyanates. Examples of the organic diisocyanates include tolylenediisocyanate, naphthylenediisocyanate, nitrodiphenyldiisocyanate, diphenylsulfonediisocyanate, diphenylmethanediisocyanate, tolylenediisocyanate dimer, isophoronediisocyanate, xylylenediisocyanate, hexamethylenediisocyanate, methylenebis(4-cyclohexylisocyanate) and the like. Of these, tolylenediisocyanate is preferred because of its good characteristics, and isophoronediisocyanate, xylylenediisocyante, hexamethylenediisocyanate and methylenebis(4-cyclohexylisocyanate) are also preferred because little or no yellowing takes place when these residues are contained.

The polyester residues represented by $R_4$, which have hydroxyl groups at ends of the molecule, are residues derived from known compounds prepared from dibasic carboxylic acids and dihydric alcohols. Examples of the carboxylic acids include succinic acid, adipic acid, pimelic acid, phthalic acid, isophthalic acid, terephthalic acid, maleic acid, fumaric acid, itaconic acid and the like. Examples of the dihydric alcohols include those indicated before.

The polyester residue, $R_4$, in the soft segment, —O—$R_4$—O—, of the general formula (A) should preferably have a number-average molecular weight not larger than 3000. This is because, within the above range, the cured product is not so flexible that there occurs no fogging of an image owing to the bleeding of a sublimable dye in the image while suppressing a lowering of heat resistance, thereby obtaining a good image-receiving sheet.

When a polyester residue as $R_4$ in the formula (A), which is obtained from a dihydric alcohol having from 2 to 6 carbon atoms and adipic acid or terephthalic acid, is used, the resulting layer 2 has preferably a higher affinity and a higher heat resistance. Thus, these polyester residues are preferred. Most preferably, the polyester residues obtained from at least one dihydric alcohol selected from ethylene glycol and propylene glycol and at least one dibasic carboxylic acid selected from adipic acid and terephthalic acid are used because the resulting layer 2 has significantly higher dyeing affinity and heat resistance characteristics.

Another type of more preferable polyester urethane acrylate has the following general formula (B), by which higher reactivity is ensured with the resulting layer 2 having high dyeing affinity and heat resistance characteristics.

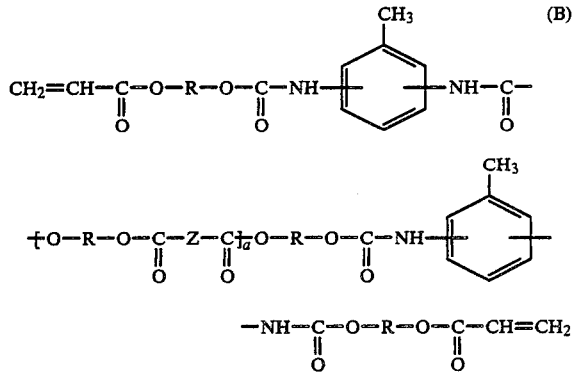

(B)

in which a is a natural number, each R represents an alkylene group, Z represents a phenylene group, a substituted phenylene group or an alkylene group. The alkylene group represented by R and Z includes, for example, groups of ethylene, propylene, ethylethylene, pentamethylene, hexamethylene or the like. Examples of the substituted phenylene group include tolylene, xylylene, ethylphenylene, cumenylene and the like.

Figure 2:
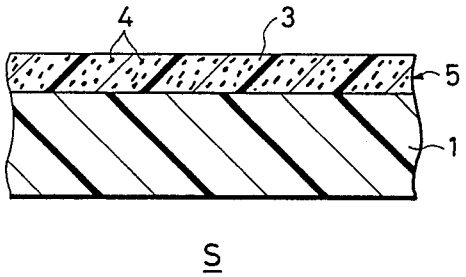
FIG. 2 is a schematic sectional view of a dye-receiving sheet according to another embodiment of the invention.

FIG. 2 shows a schematic sectional view of a dye-receiving sheet according to another embodiment of the invention. In the figure, there is shown a dye-receiving sheet S which includes a substrate 1 and a dye-receiving layer 5 which comprises a cured product of a mixture of an acrylate 3 and a saturated polyester resin 4.

The acrylate is one which is defined with reference to the first embodiment. The saturated polyester resin 4 may be any known compounds obtained from dibasic carboxylic acids and dihydric alcohols. Examples of these dibasic carboxylic acids and dihydric alcohols may be those indicated before.

The content of the saturated polyester resin in the dye-receiving layer 5 should preferably be not larger than 30 parts by weight per 100 parts by weight of the acrylate. Over this range, the heat resistance of the dye-receiving layer 5 is impeded, so that the resultant sheet is not adapted for the variable mode although it may be applicable to the non-variable mode.

For the formation of the dye-receiving layer 2 or 5, a solution of an acrylate and a polymerization initiator is applied onto the substrate 1 for the layer 2, or a solution of an acrylate, a polymerization initiator and a saturated polyester is applied onto the substrate 1 for the layer 5 by known techniques using, for example, a bar coater, a gravure coater, a knife coater, a reverse roll coater and the like. The layer 2 or 5 should preferably be coated in an amount of not less than 1 g/m$^2$. If the amount is less than 1 g/m$^2$, the recording density lowers.

The polymerization initiators are usually used for polymerization of the acrylate and are properly selected depending on the manner of polymerization. The polymerization may be effected using UV rays, electron beams, heat energy or the like as is known in the art. In an industrial sense, UV rays or heat energy is generally used.

The polymerization initiators used for polymerization with UV rays may be any compounds ordinarily used for this purpose and may be used in combination with sensitizers such as, for example, benzophenone. The polymerization initiators used on polymerization by application of heat may be peroxides such as, for example, methyl ethyl ketone peroxide.

If the acrylate in the layer 2 or 5 is cured by application of UV rays alone, the resulting layer may be, in some cases, disadvantageous in that the acrylate is apt to partially remain unreacted and the unreacted acrylate reacts, along with a UV sensitizer, with a sublimable dye, causing the deposited dye to decolor or discolor. To avoid this, curing by heat is preferred because the acrylate used is substantially polymerized and cured. The resulting dye-receiving sheet ensures a long-term stability of the dye deposited on the dye-receiving layer, thus preventing the decoloration or discoloration.

Especially, when UV sensitizers used are not reactive with sublimable dyes, curing by UV irradiation and heat in combination are industrially useful. The manner of curing is not critical in the practice of the invention and is particularly described in examples.

The layer 2 or 5 may further comprise other types of reactive monomers, reactive oligomers, curing promotors and the like. Examples of the reactive monomers include butoxyethyl acrylate, lauryl acrylate, stearyl acrylate, triethylene glycol diacrylate, neopentylglycol diacrylate, methacrylic acid, 2-hydroxyethyl methacrylate, 2-hydroxypropyl methacrylate, 2-hydroxyethyl acrylate, dimethylaminoethyl methacrylate, diethylamino methacrylate, ethylene glycol dimethacrylate, diethylene glycol methacrylate, triethylene glycol dimethacrylate, trimethylolpropane trimethacrylate, tetrahydrofurfuryl acrylate, 1,6-hexanediol diacrylate, carbitol ethyl acrylate, triglycol methyl acrylate, 2-hydroxy-3-phenyloxypropyl acrylate, trimethylolpropane triacrylate, 2-hydroxyethylacryloyl phosphate, dipentaerythritol pentacrylate, and the like. Examples of the reactive oligomers include polyester acrylates, polyol acrylates, and the like. These monomers and oligomers may be added up to 50 wt% of the main acrylate. The curing promotor may include metal chlorides such as cobalt naphthenate, amine compounds and the like.

In addition, the dye-receiving layer 2 or 5 may further comprise particles of, for example, aluminium oxide, titanium oxide, silicon dioxide, calcium carbonate, guanamine resins, polyamide resins, polypropylene resin, and the like. Lubricants and/or surface active agents may be further added.

The present invention is more particularly described by way of examples .

EXAMPLE 1

100 parts by weight of an epoxy acrylate (Ripoxy SP-1509, available from Showa Koubunshi Co., Ltd.), 5 parts by weight of 1-(4-isopropylphenyl)-2-hydroxy-2-methylpropan-1-on (Darocur 1116, available from E. Merck, Darmstadt Germany) and 500 parts by weight of ethyl acetate were mixed to obtain a coating paint. The paint was coated onto a commercially available art paper by means of a bar coater and dried, followed by irradiation with a high pressure mercury lamp of 1KW for 1 minute to obtain dye-receiving sheet 1. The coating amount was 2 g/m$^2$.

EXAMPLE 2

100 parts by weight of an oligoester acrylate (Arconix M-8030, from Toa Synthetic Chem. Ind. Co., Ltd.), 3 parts by weight of Darocur 1116 and 500 parts by weight of toluene were mixed to obtain a coating paint. The paint was coated onto a polypropylene-base synthetic paper (Yupo FPG150, available from Ohji Yuka Synthetic Paper Co., Ltd.) by means of a bar coater, followed by drying and irradiation with a high pressure mercury lamp of 1 KW for 1 minute to obtain dye-receiving sheet 2. The amount was 15 g/m$^2$.

EXAMPLE 3

32 parts by weight of a polyester urethane acrylate of the following formula having an average molecular weight of 1600, 3.8 parts by weight of dipentaerythritol hexaacrylate, 3.2 parts by weight of benzoyloxyethyl acrylate, 0.2 parts by weight of a silicone additive (kp-301, available from Shinetsu Chem. Ind. Co., Ltd.) and 100 parts by weight of ethyl acetate were mixed to obtain a coating paint. The paint was coated onto a polyester-base synthetic paper (Peach Coat SE80, available from Nisshin Boseki Co., Ltd.) by means of a bar coater. The paint was dried and irradiated with a high pressure mercury lamp of 1 KW for 1 minute to obtain dye-receiving sheet 3. The coating amount was 8 g/m$^2$.

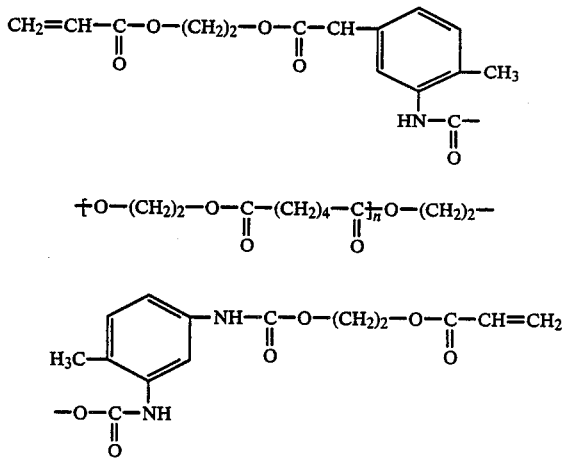

EXAMPLE 4

21 parts by weight of a polyurethane acrylate of the following formula having an average molecular weight of 3000, 1.5 parts by weight of 1-hydroxycyclohexyl phenyl ketone and 100 parts by weight of ethyl acetate were mixed to obtain a coating paint. The paint was coated onto the synthetic paper of Yupo FFG150 by means of a bar coater, followed by drying and irradiation with a high pressure mercury lamp of 1 KW to obtain dye-receiving sheet 4. The coating amount was 5 g/m$^2$.

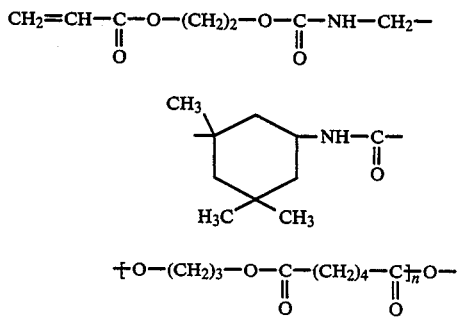

-continued

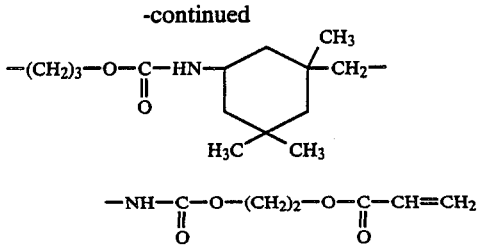

EXAMPLE 5

100 parts by weight of a polyurethane acrylate composed mainly of a compound of the following formula, 5 parts by weight of Darocur 1116 and 140 parts by weight of methyl ethyl ketone were mixed to obtain a coating paint. The paint was coated onto the synthetic paper of Peach Coat SE80 by means of a bar coater, followed by drying and irradiation with a high pressure mercury lamp of 1 KW for 2 minutes to obtain dye-receiving sheet 5. The coating amount was 2.5 g/m$^2$.

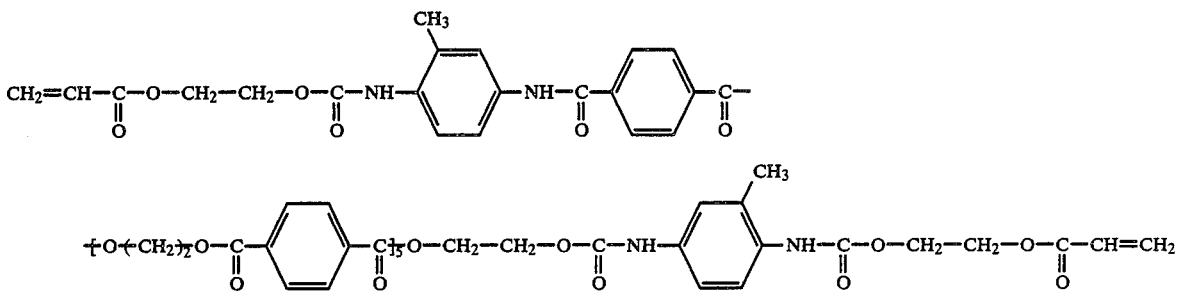

EXAMPLE 6

250 parts by weight of a polyester urethane acrylate, MCF-3M-2, available from Dainippon Ink Chem. Ind. Co., Ltd. and having a solid content of 40 wt% in a mixed solvent of methyl ethyl ketone and ethyl acetate at a ratio of 1:3, 30 parts by weight of saturated polyester Vylon #200 (available from Nisshin Boseki Co., Ltd.) and 5 parts by weight of a UV curing initiator, MCF-cat, (Dainippon Ink Chem. Ind. Co., Ltd.) were mixed to obtain a coating paint. The paint was applied onto the synthetic paper of Yupo FPG150 by means of a bar coater, followed by drying and irradiation with a high pressure mercury lamp of 1 KW for 2 minutes to obtain dye-receiving sheet 6. The coating amount of 4 g/m$^2$.

EXAMPLE 7

100 parts by weight of Ripoxy SP-1509, 3 parts by weight of benzoyl peroxide and 500 parts by weight of ethyl acetate were mixed to obtain a coating paint. The paint was applied on a commercially available art paper by means of a bar coater, followed by drying and allowing it to stand at 60° C. for 120 hours to obtain dye-receiving sheet 7. The coating amount was 2 g/m$^2$.

EXAMPLE 8

100 parts by weight of Aronix M-8030, 3 parts by weight of Darocur 1116, 1.5 parts by weight of methyl ethyl ketone peroxide, 0.5 parts by weight of cobalt naphthenate and 500 parts by weight of toluene were mixed to obtain a coating paint. The paint was applied onto the synthetic paper of Yupo FPG150 by means of a bar coater, followed by drying and irradiation with a high pressure mercury lamp of 1 KW for 1 minute. Thereafter, the sheet was allowed to stand at normal temperatures for 60 minutes to obtain dye-receiving sheet 8. The coating amount was 15 g/m$^2$.

REFERENCE

The coating paint of Example 6 was used but Vylon #200 was increased from 30 parts by weight to 50 parts by weight, and coated in the same manner as in Example 3, thereby obtaining dye-receiving sheet 1'. The coating amount was 4 g/m$^2$.

The dye-receiving sheets 1 through 8 and 1' were subjected to measurement of a color density using a dye transfer sheet under the following conditions.

The dye transfer sheet was made by a procedure in which a dispersion of 4 parts by weight of a sublimable dye having the following chemical formula, 6 parts by weight of polycarbonate, 3 parts by weight of titanium oxide and 100 parts by weight of methylene chloride was coated onto a 9 micrometer thick polyimide film by the use of a bar coater and dried to obtain a dye transfer sheet.

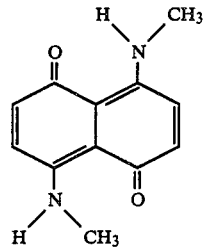

The recording conditions used were as follows.

Main and sub scanning densities: 4 dots/mm

Recording power: 0.7 W/dot

Heating time for a head: 8 ms.

(1) Non-variable mode: (running speed of dye-receiving sheet)/(running speed of dye transfer sheet)=1/1

(2) 6-fold variable mode: (running speed of dye-receiving sheet)/(running speed of dye transfer sheet)=6/1

The results are shown in Table below.

TABLE

| Dye receiving Sheet No. | Initial Density Non-variable Mode | Initial Density 6-fold Variable Mode | Density After 3 Months Non-variable Mode |
|---|---|---|---|
| 1 | 1.65 | 1.59 | 0.58 |
| 2 | 1.55 | 1.49 | 0.62 |
| 3 | 2.14 | 1.97 | 1.05 |
| 4 | 1.90 | 1.73 | 0.98 |
| 5 | 1.99 | 1.81 | 1.02 |

TABLE-continued

| Dye receiving Sheet No. | Initial Density Non-variable Mode | Initial Density 6-fold Variable Mode | Density After 3 Months Non-variable Mode |
|---|---|---|---|
| 6 | 2.05 | 1.90 | 1.15 |
| 7 | 1.62 | 1.50 | 1.58 |
| 8 | 1.51 | 1.48 | 1.47 |
| 1' | 2.06* | —** | 1.24 |

Note:
*indicates sticking between the dye transfer sheet and the dye-receiving sheet.
**indicates considerable sticking, making it impossible to run.

As will be apparent from the above table, the dye-receiving layers comprising cured products of acrylates having two acrylic or methacrylic unsaturated bonds have high affinity for the sublimable dye (sheets 1 and 2).

Upon comparison between Examples 1,2 and Examples 3,5, it will be seen that high recording densities can be obtained when using the polyester urethane acrylates of the general formulas (A) and (B).

The comparison between Example 6 and Reference reveals that when the saturated polyester is contained in an amount of 30 parts by weight or below per 100 parts by weight of the acrylate, a high recording density is obtained and the sheet can be suitably used in the n-fold variable mode. Moreover, the results of Example 3 demonstrate that when the reactive monomer or oligomer is contained in the dye-receiving layer, a high recording density is obtained. In addition, the comparison between Examples 7 and 1 or between Examples 8 and 2 reveal that thermal curing of the acrylates is suitable for preventing decoloration and discoloration of the record over a long time.

What is claimed is:

1. A thermal dye transfer assembly for heat transfer recording including a dye transfer sheet and a dye-receiving sheet for use in combination with the dye transfer sheet, said dye-receiving sheet comprising, on a sheet substrate, a dye-receiving layer consisting essentially of a cured product of an acrylate which has two acrylic or methacrylic unsaturated bonds.

2. A thermal dye transfer assembly according to claim 1, wherein said dye-receiving layer consists of the cured product of said acrylate.

3. A thermal dye transfer assembly according to claim 14 or 2, wherein said acrylate is an oligoacrylate.

4. A thermal dye transfer assembly according to claim 1 or 2, wherein said acrylate is a polyester urethane acrylate.

5. A thermal dye transfer assembly according to claim 4, wherein said polyester urethane acrylate has the following formula (A)

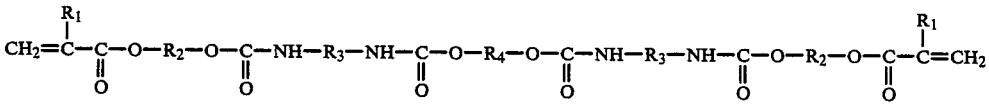

(A)

in which each $R_1$ represents H or $CH_3$, each $R_2$ represents a residue of a dihydric alcohol, each $R_3$ represents a residue of an organic diisocyanate, and $R_4$ represents a polyester residue having hydroxyl groups at opposite ends thereof.

6. A thermal dye transfer assembly according to claim 5, wherein the polyester residue represented by $R_4$ has a number average molecular weight not larger than 3000.

7. A thermal dye transfer assembly according to claim 5, wherein said polyester residue is a residue of a polyester obtained from a dihydric alcohol having from 2 to 6 carbon atoms and at least one dibasic carboxylic acid selected from the group consisting of adipic acid and terephthalic acid.

8. A thermal dye transfer assembly according to claim 7, wherein said polyester is a polyester obtained from at least one dihydric alcohol selected from the group consisting of ethylene glycol and propylene glycol and at least one dibasic carboxylic acid selected from the group consisting of adipic acid and terephthalic acid.

9. A thermal dye transfer assembly according to claim 4, wherein said polyester urethane acrylate has the following formula (B)

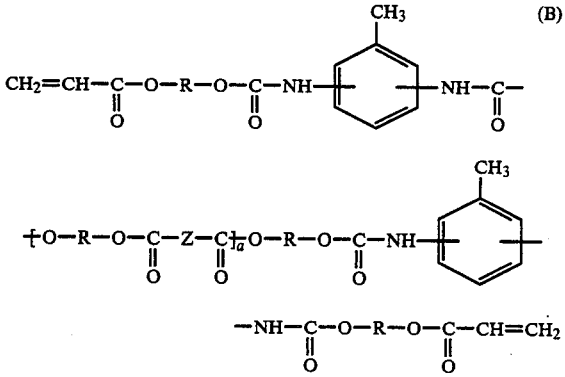

(B)

in which a is a natural number, each R represents an alkylene group, and Z represents a phenylene group, a substituted phenylene group or an alkylene group.

10. A thermal dye transfer assembly according to claim 1, wherein said dye-receiving layer comprises up to 30 parts by weight of a saturated polyester resin per 100 parts by weight of said acrylate.

11. A thermal dye transfer assembly according to claim 1 or 9, wherein said dye-receiving layer further comprises at least one reactive monomer or oligomer.

12. A thermal dye transfer assembly according to claim 1, wherein said acrylate is thermally cured.

13. A thermal dye transfer assembly according to claim 1, wherein said acrylate is cured by UV irradiation and heat.

* * * * *